US006629755B2

(12) United States Patent
Saito et al.

(10) Patent No.: US 6,629,755 B2
(45) Date of Patent: Oct. 7, 2003

(54) INK JET RECORDING HEAD, INK JET RECORDING APPARATUS, AND METHOD FOR MANUFACTURING INK JET RECORDING HEAD

(75) Inventors: Riichi Saito, Kanagawa (JP); Toshihiro Mori, Kanagawa (JP); Naruyuki Nojo, Kanagawa (JP); Shogo Kawamura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/138,585

(22) Filed: May 6, 2002

(65) Prior Publication Data

US 2002/0167567 A1 Nov. 14, 2002

(30) Foreign Application Priority Data

May 8, 2001 (JP) ..... 2001-137259
Apr. 24, 2002 (JP) ..... 2002-122891

(51) Int. Cl.[7] ..... B41J 2/05
(52) U.S. Cl. ..... 347/58
(58) Field of Search ..... 347/50, 57, 58, 347/59, 20, 56, 61

(56) References Cited

U.S. PATENT DOCUMENTS 5,081,474 A 1/1992 Shibata et al. ..... 347/59
5,491,505 A 2/1996 Suzuki et al. ..... 347/20
5,943,069 A * 8/1999 Kamiyama et al. ..... 347/58
6,119,334 A 9/2000 Watanabe et al. ..... 29/830
6,241,340 B1 6/2001 Watanabe et al. ..... 347/50

* cited by examiner

*Primary Examiner*—Craig Hallacher
*Assistant Examiner*—Juanita Stephens
(74) *Attorney, Agent, or Firm*—Fitzpatrick, Cella, Harper & Scinto

(57) ABSTRACT

To suitably electrically interconnect a recording element substrate, on which power supply paths are formed in a high density, and an electric wiring substrate, on which wiring lines for supplying power to these paths are formed, bumps are formed and arranged on the recording element substrate at a predetermined pitch therebetween so as to protrude by a predetermined distance t1 from this substrate. On the electric wiring substrate, on the other hand, connecting terminals are formed and arranged with the same pitch as that of the bumps. Between each two of the bumps is formed an insulating film which protrudes in the protrusion direction of the bumps by a predetermined distance t2, where t1<t2. By fitting the connecting terminals between respective pairs of the insulating films, each connecting terminal comes in contact with a corresponding bump with a sufficient contact area provided therebetween so as not to give rise to short-circuiting or open-circuiting.

10 Claims, 13 Drawing Sheets

INK JET RECORDING HEAD, INK JET RECORDING APPARATUS, AND METHOD FOR MANUFACTURING INK JET RECORDING HEAD

BACKGROUND OF THE INVENTION

1. Field of the Invention

The present invention relates to an ink jet recording head, an ink jet recording apparatus, and a method for manufacturing the ink jet recording head and, more particularly, to the structure and construction of a connecting section between a recording element substrate (liquid discharging substrate) on which a recording element (energy generating means) is provided and a wiring substrate for supplying power thereto.

2. Related Background Art

An ink jet recording apparatus, a so-called non-impact type recording apparatus, refers to an apparatus for recording information by discharging recording liquid (ink) onto a subject medium. This type of ink jet recording apparatus has excellent features such as high speed recording, compatibility with a variety of recording media as the subject medium in recording, and little noise production during recording. These features of the ink jet recording apparatus render it suitable for wide use as a printer or an apparatus equipped with a recording mechanism such as a word processor, a facsimile, a copy machine, etc.

Typically, this type of ink jet recording apparatus comprises an ink jet recording head including a plurality of ink jet recording nozzles, each having a discharge port for discharging liquid drops and a recording element for generating energy to discharge the liquid drops; and a liquid supply system for supplying liquid to the ink jet recording head. There are two types of ink jet recording head: one type (edge shooter) discharges recording liquid in parallel with a substrate on which the recording elements are arrayed, and the other type (side shooter) discharges recording liquid perpendicularly to a substrate on which recording elements are arrayed.

The ink jet recording head typically employs a method for using an electric thermal converting element as the recording element. By this method, thermal energy is given to liquid to utilize the pressure of bubbles produced when the liquid subsequently changes in phase to foam (boils), in order to discharge drops of the recording liquid. An ink jet recording apparatus employing such a recording method specifically supplies as a recording signal an electric pulse to an electric thermal converting element, which in turn generates thermal energy to bring about film boiling of the liquid in order to generate a pressure, which causes minute drops of the liquid to be discharged from a minute ejection outlet, thereby recording information on a subject medium.

FIG. 14 shows a recording element substrate 101 constituting an important section of a side shooter type ink jet recording head that has been used conventionally. The figure is a partially exploded perspective view.

The recording element substrate 101 comprises a substrate 102, and a member 123 including electric wiring and a liquid chamber filled with ink, which are formed on the substrate 102 by film forming technologies. The substrate 102 is made of silicon formed to a thickness of, for example, 0.5 to 1.0 mm. In the substrate 102 is formed a plurality of ink supply outlets 103 each consisting of an elongated groove shape through-outlet for receiving liquid into the liquid chamber from the outside. On either side of each of the ink supply outlets 103 on the substrate 102 a row of electric thermal converting elements 104 is arrayed. Each row is staggered with respect to its adjacent rows.

The liquid chamber is formed so that it may communicate with each of the ink supply outlets 103 and also so that it may enclose the electric thermal converting elements 104 formed on both the sides of each ink supply outlet 103. In the liquid chamber there is formed an ink flow path wall 107 constituting ink flow paths running through positions above the electric thermal converting elements 104, respectively, and there are also formed ejection outlets 108 above the electric thermal converting elements 104, respectively.

Furthermore, on the substrate 102 is formed an electric wiring line (not shown) made of aluminum (Al) for supplying power to each of the electric thermal converting elements 104, which wiring line is connected to an electrode section 105 connected to an external power supply. The electrode section 105 is provided roughly at each of two longitudinal ends on the substrate 102, and it has a plurality of arrayed connecting members 106 ("bumps") made of gold (Au).

However, an ink jet recording head using the above-described recording element substrate 101 has the following problems.

SUMMARY OF THE INVENTION

In order to implement recent photo-grade improvements in the number of colors and the picture quality of a recorded image, the ink jet recording head has been designed to have a larger number of nozzles and a smaller pitch between the nozzles. With this, therefore, the electric thermal converting elements formed on the recording element substrate have also been devised to be more numerous and less spaced from each other. Besides, along with improving functions of the electric thermal converting elements, the bumps 106 of the electrode section 105 have also been devised to be more numerous and less spaced from each other. This has brought about a larger risk of poor connection such as open-circuiting or short-circuiting occurring between the bumps 106 and the respective connecting terminals of electric wiring lines connected to an external power supply when they are connected with each other, thus leading to significant decrease in the packaging yield and the packaging reliability.

Furthermore, with the improvements in the number of colors and the picture quality, the number of nozzles, and hence the number of electric thermal converting elements, on the recording element substrate has been increased, thus increasing the power supplied to the electric thermal converter. This has brought about the need to suppress the connection resistance between the recording element substrate and the electric wiring substrate.

Furthermore, the higher density of the electric thermal converters and hence of the electric wiring lines has been a factor in the increased cost of ink jet recording heads. To solve these problems, it is desired to improve the packaging yield and reliability and reduce the connection resistance without increasing the costs significantly.

The present invention is devised taking into account the above-mentioned problems of the conventional technologies. It is, therefore, an object of the present invention to provide an ink jet recording head having a recording element substrate on which power supply paths are formed densely, and electric wiring for connecting the recording element substrate to an external device, so as to be able to prevent poor connections, such as open-circuiting or short-circuiting, from occurring between the recording element substrate and connecting terminals of the electric wiring, in order to thereby improve the packaging yield and reliability and also to reduce the connection resistance when the recording element substrate and the electric wiring are connected with each other. It is another object of the present invention to provide such an ink jet recording head without increasing the manufacturing costs thereof significantly.

To this end, an ink jet recording head according to the present invention comprises:

a liquid discharging substrate provided with both (1) a plurality of energy generating elements for generating energy utilized to discharge liquid from each of a plurality of ejection outlets in response to an electric signal and (2) a plurality of connecting members electrically connected to said plurality of energy generating elements, respectively; and an electric wiring substrate having a plurality of connecting terminals connected to said plurality of connecting members, respectively, for transmitting an electric signal supplied from the outside to said plurality of energy generating elements, respectively, wherein:

each of said plurality of connecting members protrudes from said liquid discharging substrate by a predetermined protrusion amount;

said liquid discharging substrate has, between said plurality of connecting members, an insulating member comprised of at least one member protruding in the same direction as said plurality of connecting members; and the protrusion amount of said insulating members is larger than the protrusion amount of each of said plurality of connecting members.

By this configuration, it is possible to fit each of said plurality of connecting terminals between a respective pair of adjacent insulating members so that said each of said plurality of connecting terminals may come in good contact with a respective one of said plurality of connecting members when said liquid discharging substrate and said electric wiring substrate are fixed to each other, with a sufficient contact area provided between each of said plurality of connecting terminals and the respective one of said plurality of connecting members, without short-circuiting or open-circuiting.

Preferably, the insulating member placed between each two adjacent ones of said plurality of connecting members is formed of the same material as the liquid chamber filled with liquid and in the same process as that for forming the liquid chamber, in a step for forming the member constituting the liquid chamber on the liquid discharging substrate, preferably, by photolithography. It is thus possible to form the insulating members with little increase in the manufacturing costs. Moreover, if the liquid chamber is comprised of an orifice member and a partition member, preferably the insulating member placed between each two adjacent connecting members is formed of the same material as the partition member and in the same process as that for forming the partition member, preferably, by photolithography.

In the ink jet recording head of the present invention, preferably, any of the following methods is employed to suitably electrically interconnect the connecting members and the connecting terminals, respectively, with a suppressed contact resistance therebetween.

One method comprises the steps of:

filling a gap between a liquid discharging substrate and an electric wiring substrate with a thermo-hardening adhesive agent around connecting sections, respectively, of each connecting member and its corresponding connecting terminal in a state where said each connecting member and said each connecting terminal are arranged on said liquid discharging substrate and said electric wiring substrate, respectively, in such a manner as to be in contact with each other; and heating and thereby hardening said thermo-hardening adhesive agent by applying a pressure across said liquid discharging substrate and said electric wiring substrate in such a direction as to press said connecting members and said connecting terminal to each other, respectively.

In this case, preferably the thermo-hardening adhesive agent is an anisotropic conductive one containing conductive particulates, because this type of thermo-hardening adhesive agent is suitable for high-density packaging.

Another method involves gang bonding by means of heating the connecting member and the connecting terminals under pressure. A further method involves single-point bonding by means of a supersonic load on each connecting member and each connecting terminal.

An ink jet recording apparatus according to the present invention comprises the above-mentioned ink jet recording head mounted thereon. This ink jet recording apparatus can suitably supply power with a low resistance to energy generating means provided in the ink jet recording element and so can suitably drive each of the energy generating means to thereby record an image with a high picture quality.

An ink jet recording head manufacturing method according to the present invention comprises the steps of:

forming on a liquid discharging substrate a plurality of energy generating elements for generating energy utilized to discharge liquid from discharge ports in response to an electric signal;

forming on said liquid discharging substrate a plurality of connecting members which are connected to said energy generating elements, respectively, and which protrude from a surface of said liquid discharging substrate by a predetermined protrusion amount;

forming, between every two adjacent ones of said plurality of connecting members on said liquid discharging substrate, an insulating member comprised of at least one member protruding more than said predetermined protrusion amount, in the same direction as that in which said plurality of connecting members protrude;

fitting each of a plurality of connecting terminals, which is provided on an electric wiring substrate and connected with a respective one of said plurality of connecting members, between two adjacent insulating members so that said connecting terminals and said connecting member may come in contact with each other, respectively, in order to transmit an electric signal supplied from the outside to said energy generating elements, respectively; and fixing said liquid discharging substrate and said electric wiring substrate to each other in such a position that respective connecting members and connecting terminals come in contact with each other.

DESCRIPTION OF THE PREFERRED EMBODIMENTS

The following will describe preferred embodiments of the present invention with reference to the drawings.

Figure 1:
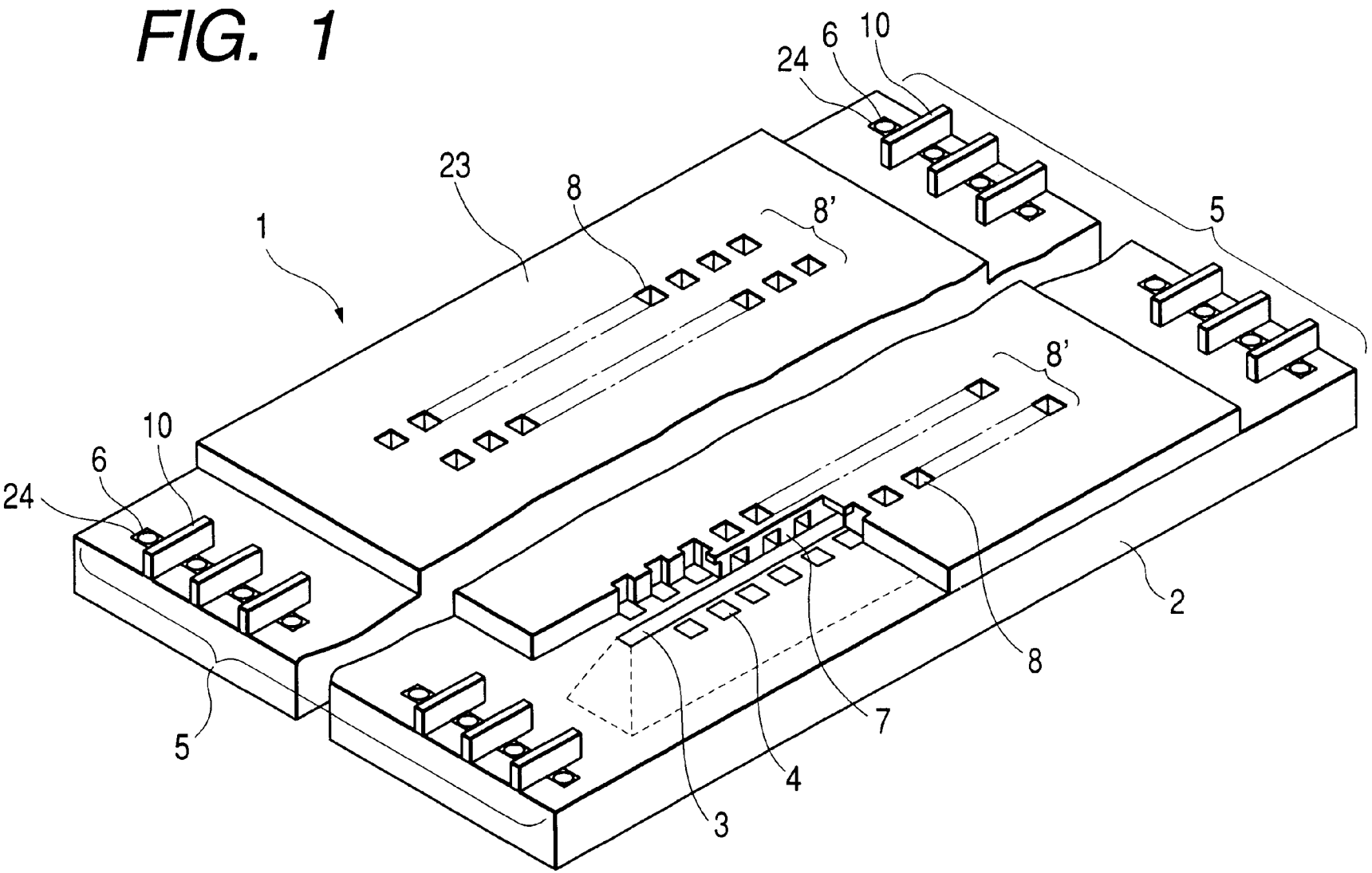
FIG. 1 is a partially exploded perspective view for showing a recording element substrate according to a first embodiment of the present invention.

FIG. 1 is a perspective view for showing a recording element substrate (liquid discharging substrate) 1 which constitutes an ink jet recording head according to this embodiment, as partially exploded to explain its configuration.

A recording element substrate 1 comprises a substrate 2, and electric wiring, a member 23 constituting a liquid chamber filled with ink, etc., which are formed on the substrate 2. The substrate 2 is made of Si formed to a thickness of, for example, 0.5 to 1.0 mm. In the substrate 2 are formed a plurality of ink supply outlets 3, each consisting of a long groove-shaped through-outlet for receiving liquid in the liquid chamber from the outside. On either side of each of the ink supply outlets, one row of electric thermal converting elements (energy generating means) 4 is arrayed.

The liquid chamber is formed in such a manner as to communicate with each ink supply outlet 3 and also to enclose the electric thermal converting elements formed on both sides of each ink supply outlet 3. In the liquid chamber is formed an ink flow path wall 7 constituting ink flow paths, each of which runs from the ink supply outlet 3 to a position above a respective electric thermal converting element 4, and each of which has a discharge port 8 formed therein at a corresponding position above the respective electric thermal converting element 4.

Furthermore, on the substrate 2 are formed electric wiring lines made of Al, etc., for supplying power to respective electric thermal converting elements 4, which wiring line is connected to an electrode section 5 connected to an external power supply source. The electrode section 5 is provided nearly at both longitudinal ends of the substrate 2 and has a plurality of electrode pads 24 formed thereon arranged with a predetermined pitch therebetween. On each of which the electrode pads 24 is formed a connecting member 6 (a "bump") made of Au, etc. Between each two bumps 6 is formed an insulating member 10 which protrudes from the formation surface of the bump 6 in the same direction as the bump 6 does. Although the insulating member 10 is shown in FIG. 1 to have the shape of a rectangular prism, it may be a cylinder, a cone, or any other similar shape to obtain the same effects.

Utilizing the crystal orientation of the substrate 2, the ink supply outlet 3 is formed by anisotropic etching in such a manner as to extend from the formation surface of the electric thermal converting element 4 widely to its opposite side surface. If the substrate 2 has, for example, a wafer surface-directional crystal orientation of <100> and a thickness-directional crystal orientation of <111> and anisotropic etching is conducted on an alkali-based substance (KOH, TMAH, hydrazine, etc.), the etching proceeds at an angle of about 54.7 degrees. By this method, the ink supply outlet 3 can be formed to have a desired depth and a desired widening angle. Moreover, a member 23 that constitutes the liquid chamber is comprised of a construction film made of an epoxy-based material formed in a predetermined pattern by photolithography.

This recording element substrate 1 utilizes the electric thermal converting element 4 to generate an air bubble in ink supplied through an ink flow path 9 to thereby eject the ink through the discharge port 8. The recording element substrate 1 is combined with an ink supply system for supplying ink thereto and a member connected to an electrical system for supplying power thereto to thereby constitute a recording element unit, a plurality of which units are combined as necessary to constitute an ink jet recording head of this embodiment.

Figure 2:
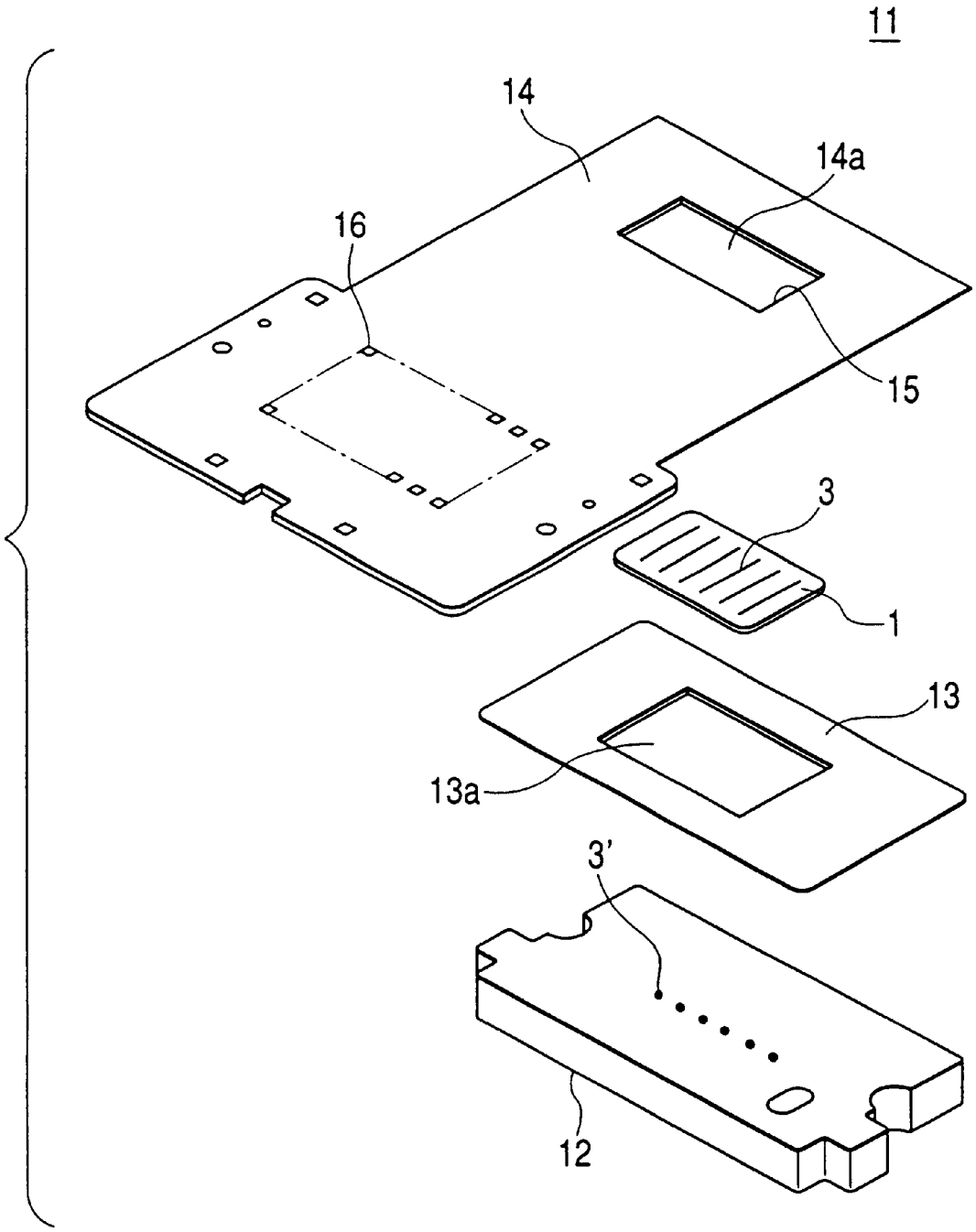
FIG. 2 is an exploded perspective view for showing a recording element unit in which the recording element substrate of FIG. 1 is incorporated.

FIG. 2 shows an exploded perspective view of the recording element unit 11 of this embodiment. This recording element unit 11 is provided by joining the recording element substrate 1, a first plate 12, a second plate 13, and an electric wiring substrate 14.

The first plate 12 has a plurality of ink supply outlets 3' formed therein at such positions as to be connectable to the ink supply outlets 3 formed in the recording element substrate 1. The recording element substrate 1 is adhered and fixed onto the first plate 12 at such a high accuracy in positioning that the ink supply outlets 3' may be interconnected with the ink supply outlets 3 facing the first plate 12. The first plate 12 has a thickness of, for example, 0.5 to 10.0 mm.

The second plate 13 has an opening 13*a* formed therein, which is larger than an external size of the recording element substrate 1. The second plate 13 is adhered and fixed onto the first plate 12 in such a position that the recording element substrate 1 may be placed in the opening 13*a*.

The electric wiring substrate 14 is a member for transmitting to the recording element substrate 1 an electric signal for discharging ink. Near one end of the electric wiring substrate 14 is formed an opening 14*a* for exposing the discharge ports 8 formed in the recording element substrate 1, while near the other end and on the right side surface thereof is formed a plurality of external signal input terminals 16 arranged in a predetermined pattern to be connected to an external signal supply source. Near an edge of the opening 14*a* and on the side surface opposite to the formation side surface of the external signal input terminal 16 is formed a plurality of connecting terminals 15 with the same pitch therebetween as the pitch between the bumps 6 formed on the recording element substrate 1. The electric wiring substrate 14 has wiring, not shown, for interconnecting the external signal input terminals 16 and the connecting terminals 15.

The electric wiring substrate 14 is adhered and fixed onto the second substrate 13 in such a manner that the connecting terminals 15 may be connected to the bumps 6, respectively, on the recording element substrate 1. The second plate 13 has roughly the same thickness as the substrate 2 so that in this joining of the electric wiring substrate 14 and the second plate 13 the connecting terminals 15 and the corresponding bumps 6 may be electrically interconnected in a plane without giving rise to unnecessary stress in the joining direction at the interconnecting section and its surroundings. The thickness of this second plate is, for example, 0.5 to 1.0 mm approximately.

The first plate 12 and the second plate 13 are made of alumina ($Al_2O_3$) in this embodiment. Although the material of the first and second plates 12 and 13 is not limited to alumina, preferably the material of these plates has roughly the same linear expansion coefficient and at least roughly the same heat transfer rate as those of the material of the recording element substrate 1. The preferabe materials include, for example, silicon (Si), aluminum nitride (AlN), zirconium, silicon nitride ($Si_3N_4$), silicon carbonate (SiC), molybdenum (Mo), and tungsten (W).

An ink jet recording head comprised of such a recording element unit 11 is incorporated in, for example, an ink tank holder for holding detachably an ink tank storing ink therein. In this case, an ink supply path formed in contact with a supply outlet in the ink tank is connected to the ink tank holder at an opening formed in the back side surface opposite to the surface to which is joined the recording element substrate 1 and the ink supply outlet 3' of the first plate 12. Then, the ink stored in the ink tank is supplied through the ink supply outlet 3' and 3 into the liquid chamber formed on the recording element substrate 1.

This ink tank holder is mounted, for example, on the carriage of an ink jet recording apparatus, in which case the external input signal terminals 16 are abutted against the electrical terminal on the side of the body of the recording apparatus to be electrically connected to an electrical system of the body of the recording apparatus. The ink jet recording apparatus selectively applies an electric pulse through the external signal input terminals 16 to the electric thermal converting elements 4 at a predetermined timing while reciprocating the carriage and also carrying a subject medium to thereby change the relative positional relationship between the ink jet recording head and the subject medium, thus discharging ink from the ink jet recording head to record information.

The following will describe in more detail the structure and construction of the connecting section between the recording element substrate 1 and the electric wiring substrate 14 with reference to FIGS. 3A to 3D. FIGS. 3A to 3D are schematic cross-sectional views for showing the connecting section between the recording element substrate 1 and the electric wiring substrate 14.

Figure 3C:
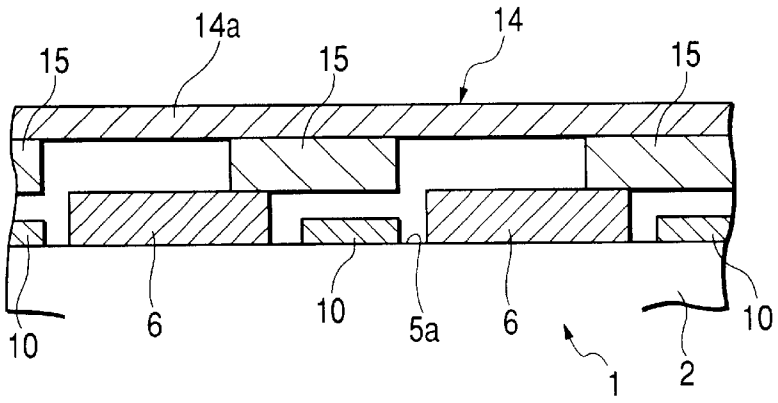
FIG. 3A is a cross-sectional view for showing a connecting section between the recording element substrate and an electric wiring substrate of the first embodiment of the present invention and FIGS. 3B, 3C and 3D are cross-sectional views for showing a connecting section of conventional examples.
Figure 3D:
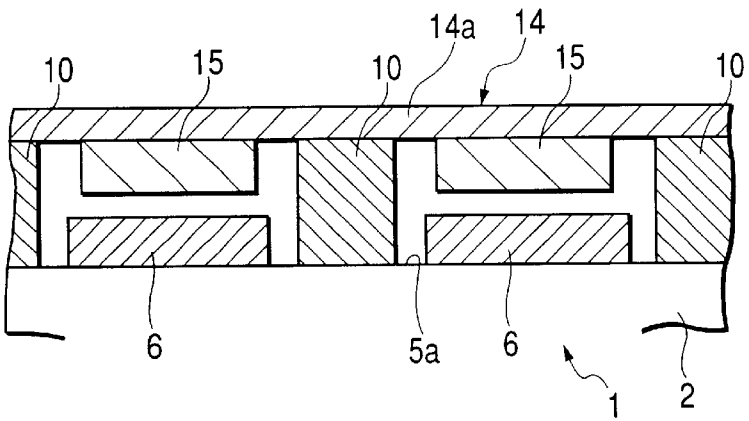
Figure 3A:
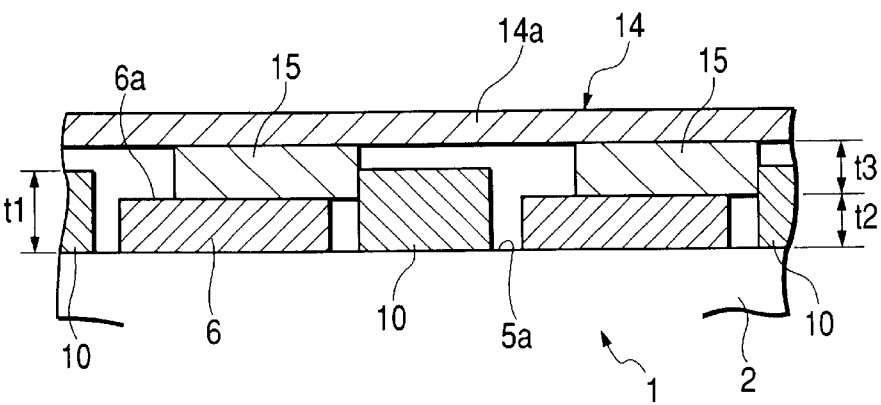

As mentioned above, the electrode section 5 of the recording element substrate 1 of this embodiment has a plurality of insulating films (insulating members) 10 formed thereon. As shown in FIG. 3A, the thickness (height) of this insulating film 10 is larger than that of the bump 6 and smaller than the sum of the thicknesses of bump 6 and connecting terminal 15. That is, supposing the thickness of the insulating film 10 to be t1, that of the bump 6 to be t2, and that of the connecting terminal 15 to be t3, a relationship of ($t2<t1<t2+t3$) is established. Note here that although the bump 6 is shown in FIGS. 3A to 3D to be flat on its right side surface, it may generally be of any other shape. Also note that the thickness of the bump 6 refers more strictly to a distance from a top 6*a* of the bump 6 to a surface 5*a* of the electrode section 5.

The insulating film 10 having such a configuration is provided to the ink jet recording head of this embodiment, to prevent short-circuiting or open-circuiting at the intersection of the bump 6 and the connecting terminal 15. This is described with reference to FIGS. 3B, 3C, and 3D showing cross-sectional views of the connecting section of a comparison example of this embodiment.

Although the electric wiring substrate 14 is positioned in such a fashion, when joined to the recording element substrate 1, that each of the bumps 6 is abutted against the corresponding connecting terminal 15 as mentioned above, the electric wiring substrate 14 may shift. This shifting may have a significant influence especially if the bumps 6 and the connecting terminals 15 are formed with a narrow pitch therebetween.

Figure 3B:
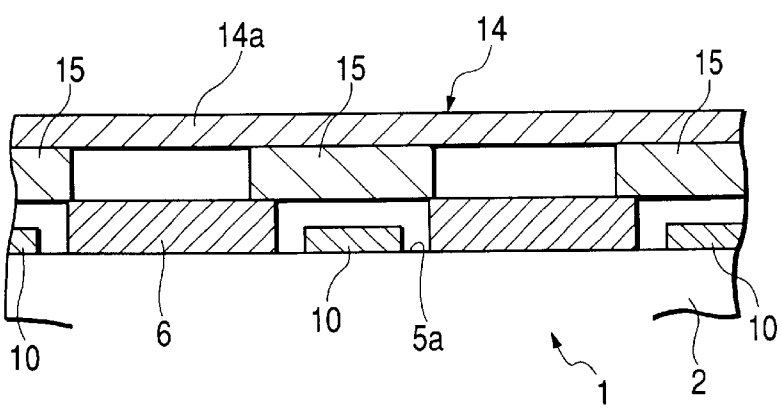

If the insulating film 10 is not provided at all or is thinner than the bump 6, the connecting terminal 15 may come in contact with the adjacent bumps 6 on both sides thereof, giving rise to short-circuiting, as shown in FIG. 3B. Moreover, even if it does not come in contact with both adjacent bumps to such an extent as to give rise to short-circuiting, as shown in FIG. 3C the bump 6 and the connecting terminal 15 may be separated from each other greatly so as to decrease the connecting area therebetween, thus increasing the connection resistance.

According to this embodiment, on the other hand, each connecting terminal 15 can be fitted between each two of the insulating films 10 to suppress the shift to a predetermined amount or less, thus properly electrically interconnecting each bump 6 and its corresponding connecting terminal 15.

In a case where, according to this embodiment, the electric wiring substrate 14 overlaps such a section of the recording element substrate 1 that has the bumps 6 and the insulating films 10 formed thereon to thereby interconnect the connecting terminal 15 and the bump 6, if the thickness of the insulating film 10 is larger than a total sum of the thickness of bump 6 and that of the connecting terminal 15, as shown in FIG. 3D, the bump 6 and the connecting terminal 15 do not come in contact with each other, thus giving rise to open-circuiting therebetween in some cases. To guard against this, the thickness of the insulating film 10 is set smaller than the sum of the thicknesses of the bump 6 and the connecting terminal 15.

This embodiment thus makes it possible to position the bump 6 and the connecting terminal 15 at a high accuracy by using such a relatively simple method of providing the insulating film 10. In this embodiment, especially, this insulating film 10 is preferably formed in the same semiconductor manufacturing process as that for the member 23, which constitutes the liquid chamber. That is, as mentioned above, the member 23 of the liquid chamber is comprised of a construction film made of an epoxy-based material formed in the predetermined pattern by photolithography, so that by changing this film forming pattern, the insulating film 10 can be formed from this construction film made of an epoxy-based material. By thus forming the insulating film 10, it is possible to eliminate the necessity of adding a new semiconductor manufacturing process for forming the insulating film 10, and therefore to avoid a significant increase in the manufacturing cost.

Note here that, preferably, the following connecting process is performed so that the bump 6 and the electric connecting terminal 15 may suitably be interconnected electrically with a suppressed contact resistance therebetween in such a contact state as mentioned above.

Figure 4:
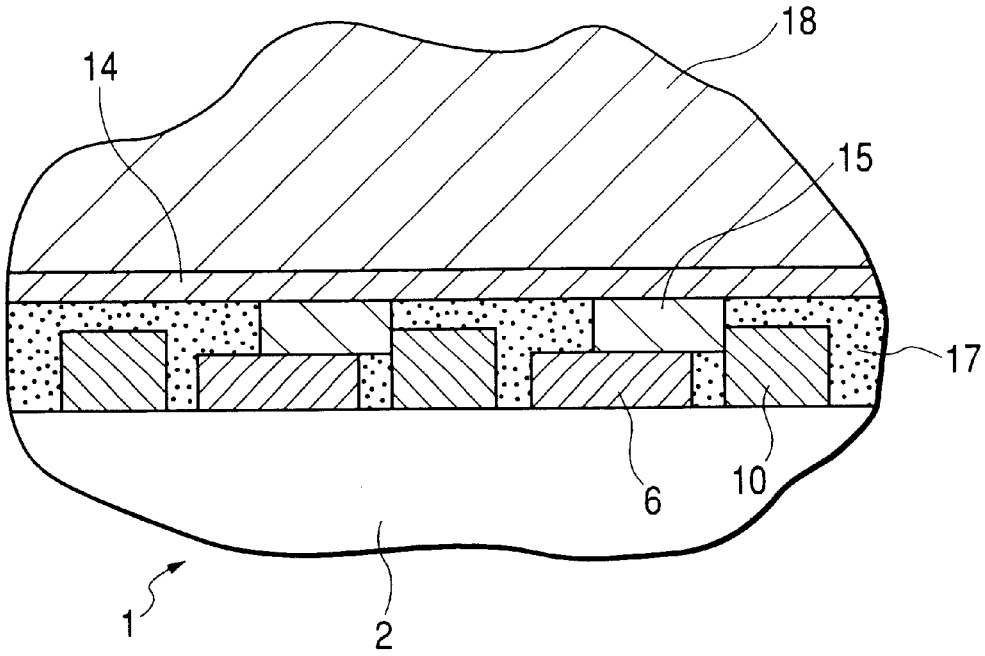
FIG. 4 is a cross-sectional view for showing the connecting section of a connection example of the first embodiment of the present invention.
Figure 5:
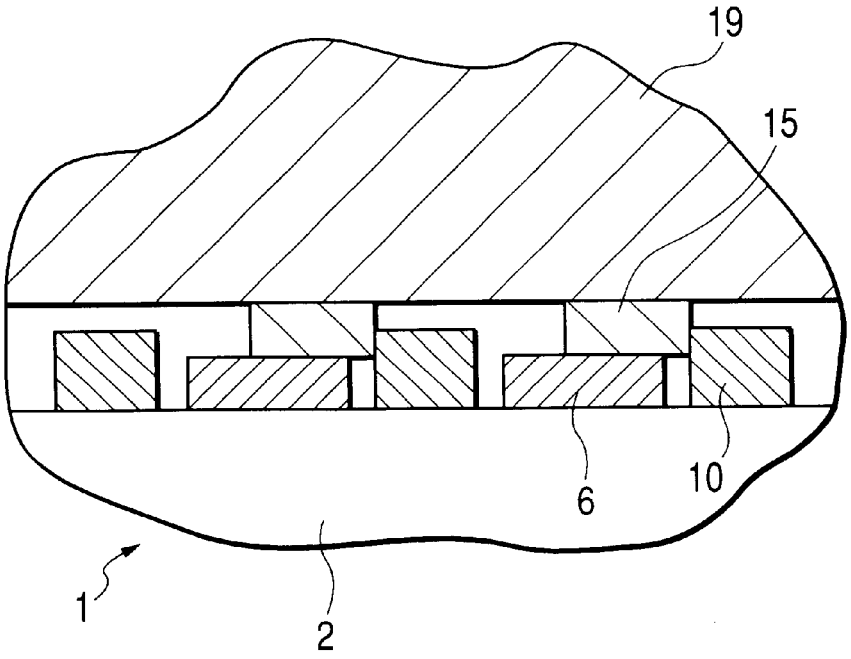
FIG. 5 is a cross-sectional view for showing the connecting section of another connection example of the first embodiment of the present invention.

By one connecting method, as shown in FIG. 4, a thermo-hardening adhesive agent 17 made mainly of an epoxy-based resin is used as the connecting material. This thermo-hardening adhesive agent 17 is heated by applying a pressure across the bump 6 and the connecting terminal 15 in such a direction as to press them to each other, thereby interconnecting them. That is, the thermo-hardening adhesive agent 17 can be used to fill the gap between the electric wiring substrate 14 and the substrate 2 to then interconnect them by heating them with a heat tool 18 under pressure, thus suitably electrically interconnecting them with a suppressed contact resistance therebetween. In this case, more preferably, an anisotropic conductive adhesive agent containing conductive particles suitably fitted to high-density packaging is employed as the thermo-hardening adhesive agent 17. By another connecting method, as shown in FIG. 5, a gang bonding tool is used to heat the electric wiring substrate 14 and the substrate 2 under pressure to interconnect them. This method is suitably fitted to a case of using as the electric wiring substrate 14 something in which at least the vicinity of the connecting section between itself and the bump 6 is made of TAB (Tape Automated Bonding) tape. By this method also, the connecting terminal 15 and the bump 6 can be suitably electrically interconnected.

Figure 6:
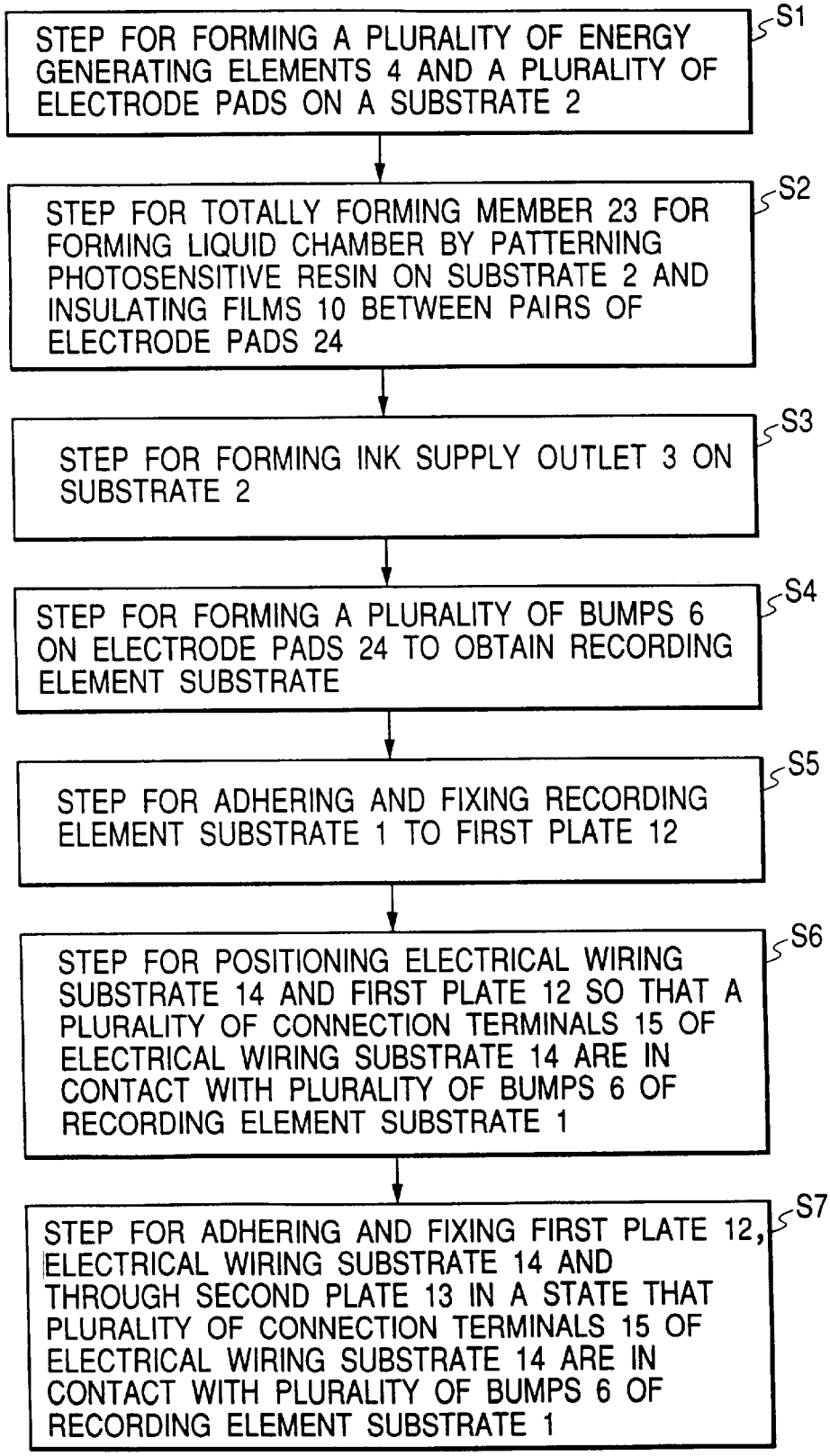
FIG. 6 is a flowchart for showing steps for manufacturing the recording element substrate unit according to the first embodiment of the present invention.

The recording element unit constituting an ink jet recording head of this embodiment mentioned above can be manufactured by the following process (see FIG. 6).

First, the electric thermal converters 4, the electrode pads 23, etc. are formed on the silicon substrate 2 by patterning using photolithography (S1). Then, as shown in FIG. 1, an epoxy-based photosensitive resin is applied on the thus patterned silicon substrate 2 to form the member 23 for forming the liquid chamber into which liquid is supplied. In this case, in this semiconductor manufacturing process, the insulating film 10 is also formed from this photosensitive resin between each two of the electrode pads simultaneously (S2). Note here that the photosensitive resin according to this embodiment is formed to a thickness of, for example, 0.03 mm.

Next, anisotropic etching, sandblasting, etc. is used to form the ink supply outlet 3 of FIG. 1 in the silicon substrate 2 (S3). Further, on the electrode pads on the silicon substrate 2, the plurality of bumps 6 of FIG. 1 are formed in a row by, for example, forming a ball electrode (stud bump) by means of plating patterning or wire bonding (S4). Then, the silicon substrate 2 is cut to form an external profile, thus obtaining a recording element substrate. Note here that in this embodiment the bump 6 is formed to a height of, for example, 0.02 mm.

The recording element substrate thus obtained 1 is adhered and fixed onto the first plate 12 at a position thereof where the ink supply outlet 3' is provided, using an adhesive resin (not shown) (S5).

Next, in a state where electric wiring substrate 14 is overlapped on said recording element substrate 1 at a section thereof where each bump 6 is provided, each connecting terminal 15 of the electric wiring substrate 14 is positioned as fitted between two of the insulating films 10 to be in contact with a corresponding bump 6 (S6), so that subsequently the surroundings of the joining section between each bump 6 and its corresponding connecting terminal 15 are filled with the thermo-hardening adhesive agent 17 or an anisotropic conductive adhesive agent 27 to interconnect each bump 6 and its corresponding connecting terminal 15 by adhesion by means of heating. Moreover, the electric wiring substrate 14 is adhered and fixed onto the first plate 12 via the second plate 13 having the opening 13*a* corresponding to the recording element substrate 1, using an adhesive agent (S7).

Note here that although the anisotropic conductive adhesive agent 27 is temporarily adhered or applied to the connecting terminal 15 beforehand when, as mentioned above, each connecting terminal 15 of the electric wiring substrate 14 and each bump 6 of the recording element substrate 1 are interconnected and adhered and fixed to each other, the present invention is not limited thereto; for example, the anisotropic conductive adhesive agent 27 may be temporarily adhered or applied to each bump 6 of the recording element substrate 1. Moreover, although the adhesive resin is temporarily adhered or applied to the side of the first plate 12, the present invention is not limited thereto; for example, it may be temporarily adhered or applied to the side of the electric wiring substrate 14.

Furthermore, the electric wiring substrate 14 of this embodiment may be comprised of a base film with a thickness of 0.025 mm and the connecting terminals 15 each having a thickness of 0.02 mm.

The above-mentioned steps are used to manufacture the recording element substrate unit of an ink jet recording head according to this embodiment.

Figure 7:
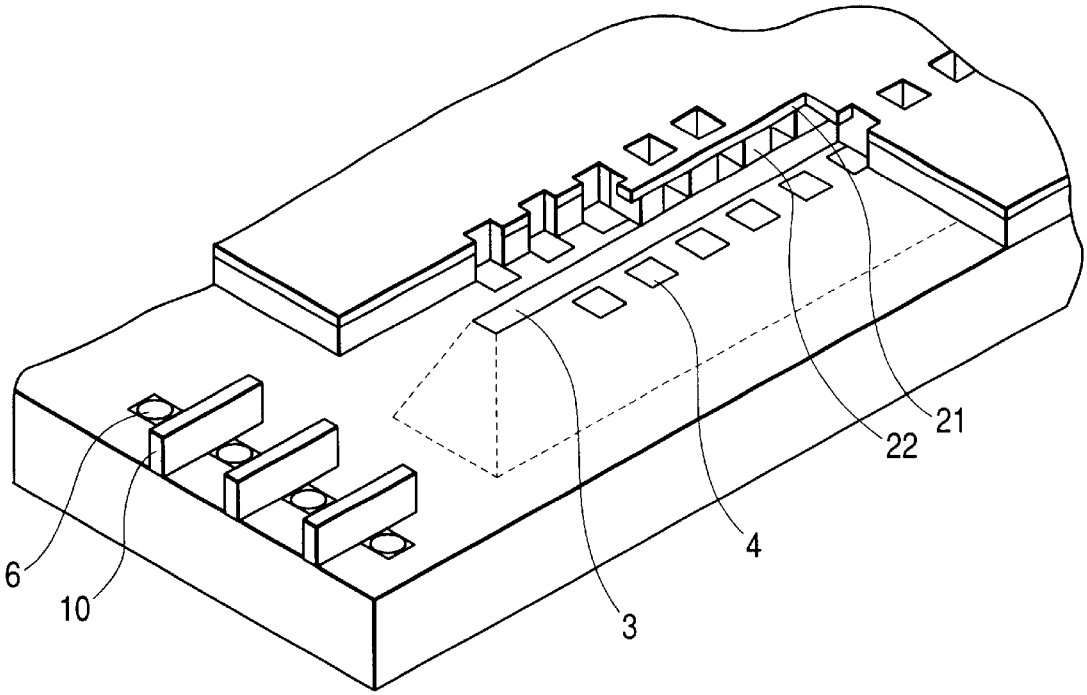
FIG. 7 is an expanded view for showing an important part of an example of the first embodiment of the present invention in which a liquid chamber is comprised of an orifice member and a partition member.

Further, also in a case where, as shown in FIG. 7, the liquid chamber formed on the above-mentioned recording element substrate 1 is comprised of an orifice member 21 having the discharge ports 8 and a partition member 22 and the above-mentioned insulating film 10 is formed in the same semiconductor manufacturing process as the partition member 22, it is not necessary to add a new semiconductor manufacturing process for forming the insulating film 10, thus not significantly increasing the manufacturing cost.

Second Embodiment

Figure 10A:
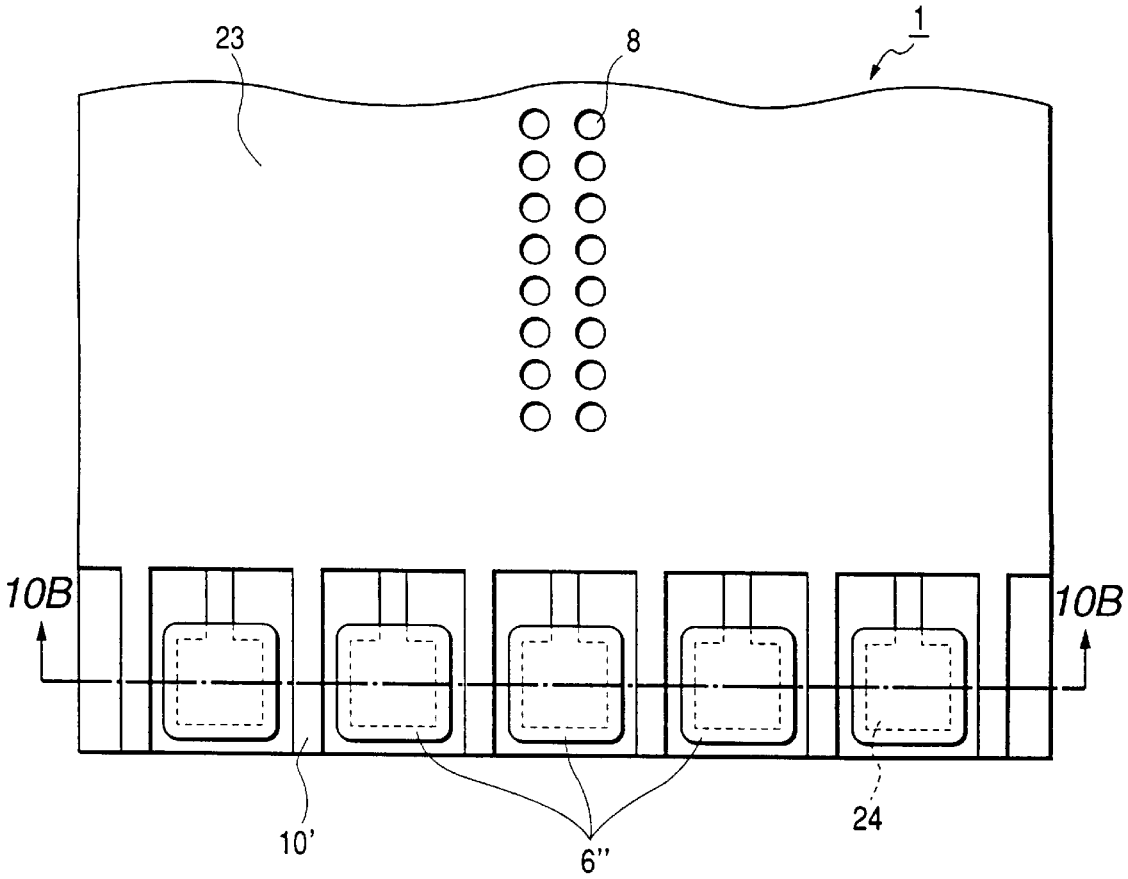
FIG. 10A is a top view for showing important parts of the recording element substrate and the electric wiring substrate before being connected to each other according to a second example of the second embodiment of the present invention and FIG. 10B is a cross-sectional view taken along line 10B—10B of FIG. 10A.
Figure 10B:
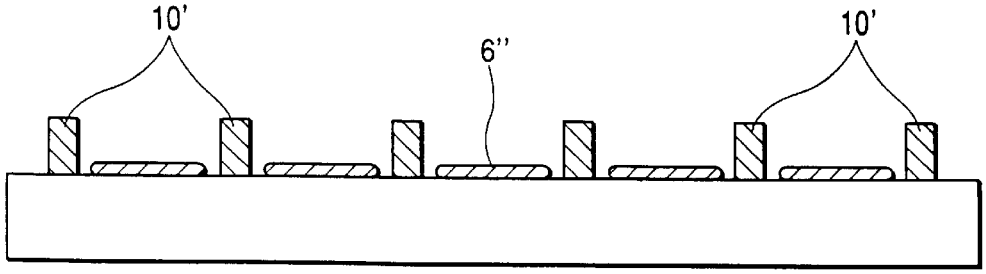
Figure 11:
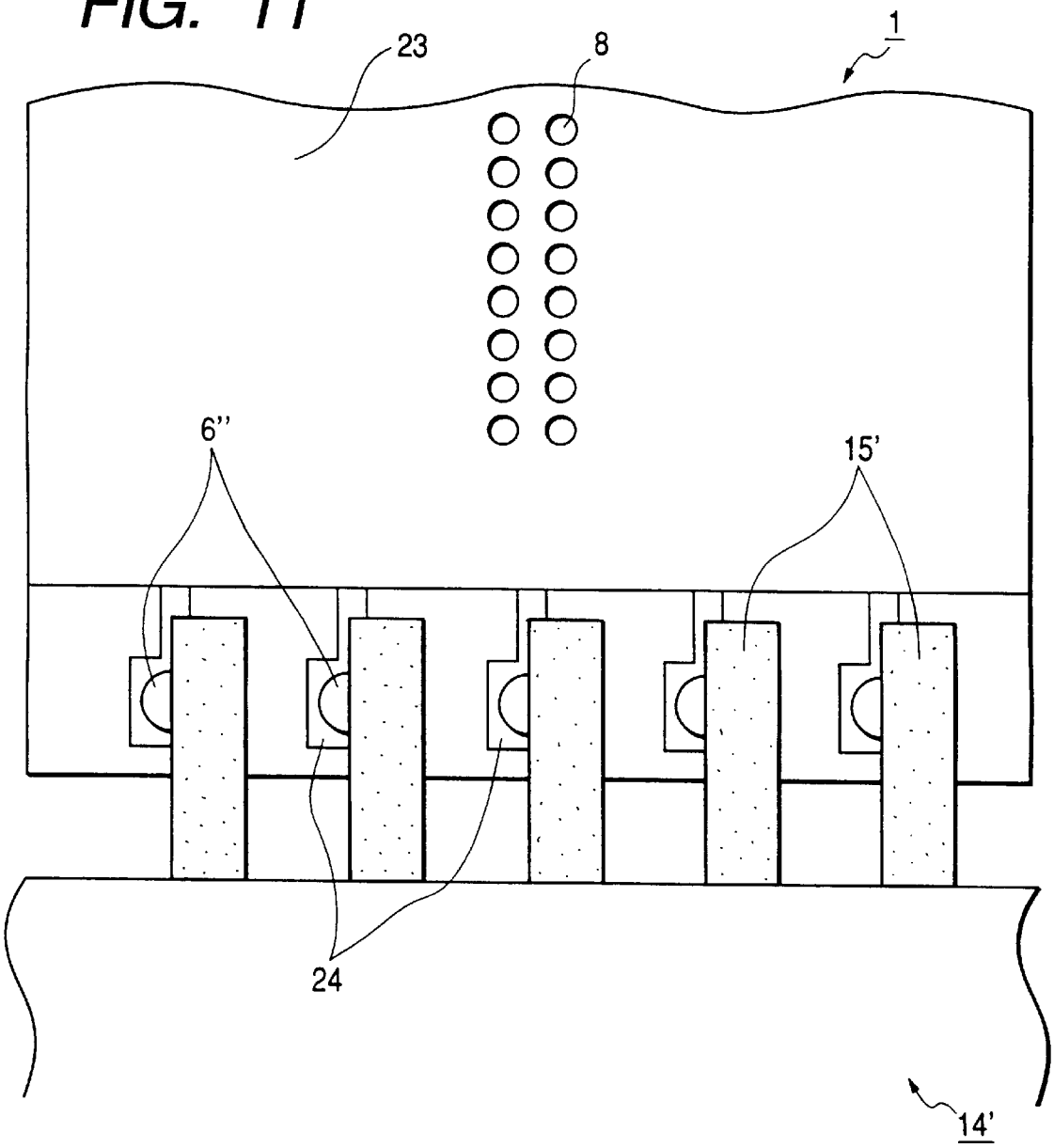
FIG. 11 is a top view for showing important parts of the recording element substrate and the electric wiring substrate after being connected to each other according to the second example of the second embodiment of the present invention.
Figure 12:
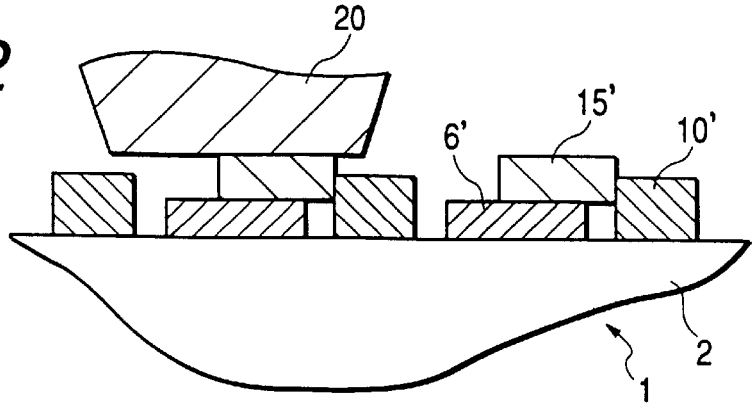
FIG. 12 a cross-sectional view for showing the connecting section of a connection example according to the second embodiment of the present invention.

The following will describe the second embodiment of the present invention with reference to FIGS. 8A and 8B, and FIGS. 9 to 12. In this embodiment, the bump 6' is connected by single bonding by use of a supersonic load with a connecting terminal 15' consisting of a portion of an inner lead that has been exposed in the opening 14*a* by partially removing the base film at the opening 14*a* formed in the electric wiring substrate 14'. In this case, as shown in FIG. 12, for example, a single-point TAB tool 20 by Geizer can be used to electrically interconnect the connecting terminal 15' and the bump 6' suitably by using a supersonic load. Moreover, in this embodiment, the insulating film 10' is formed of the material of the liquid chamber continuously therewith so as to be thereby formed integrally with the plurality of bumps 6' sandwiching it, thus improving the strength of the insulating film and also the joining strength between the insulating film and the recording element substrate as compared to the first embodiment. This in turn improves the yield and the connection reliability as compared to the first embodiment.

Figure 8A:
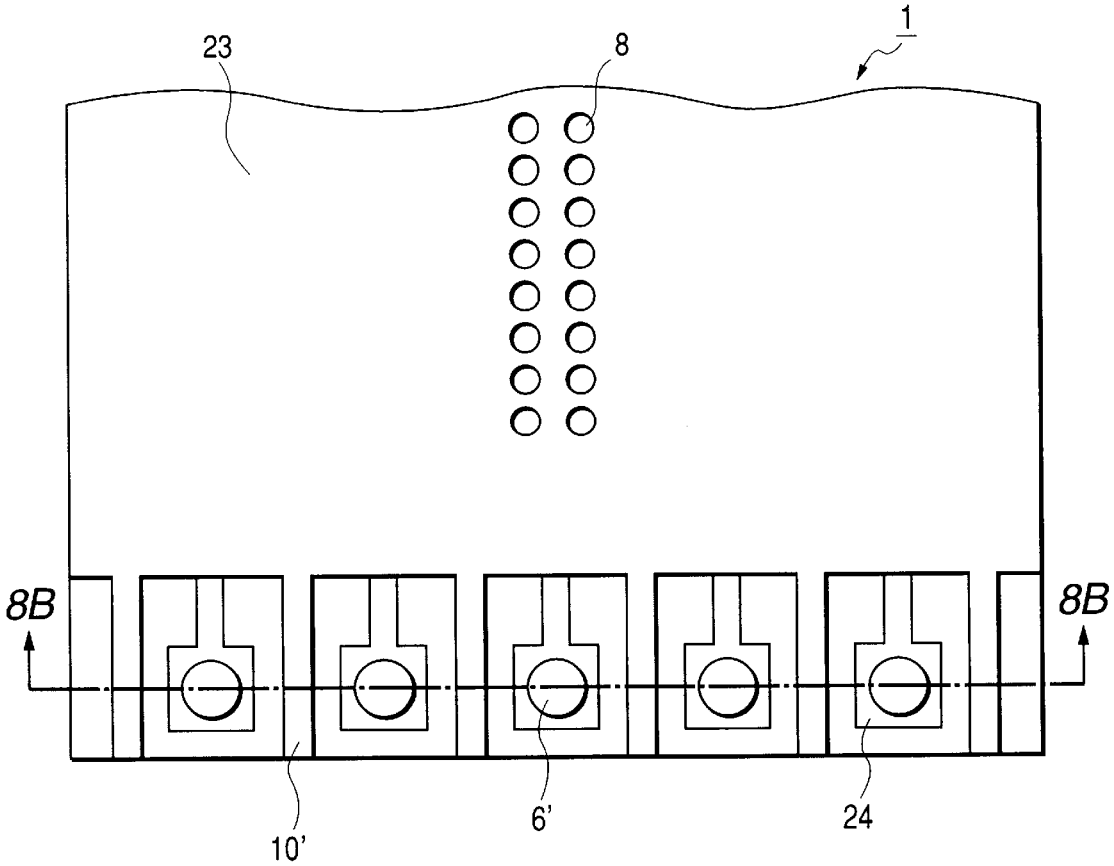
FIG. 8A is a top view for showing important parts of the recording element substrate and the electric wiring substrate before being connected to each other according to a first example of a second embodiment of the present invention and FIG. 8B is a cross-sectional view taken along line 8B—8B of FIG. 8A.
Figure 8B:
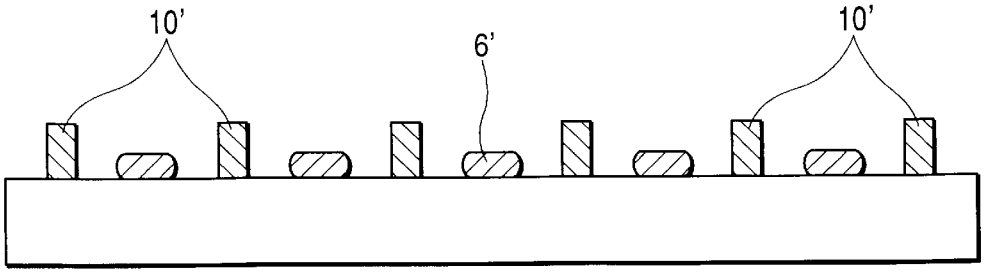
Figure 9:
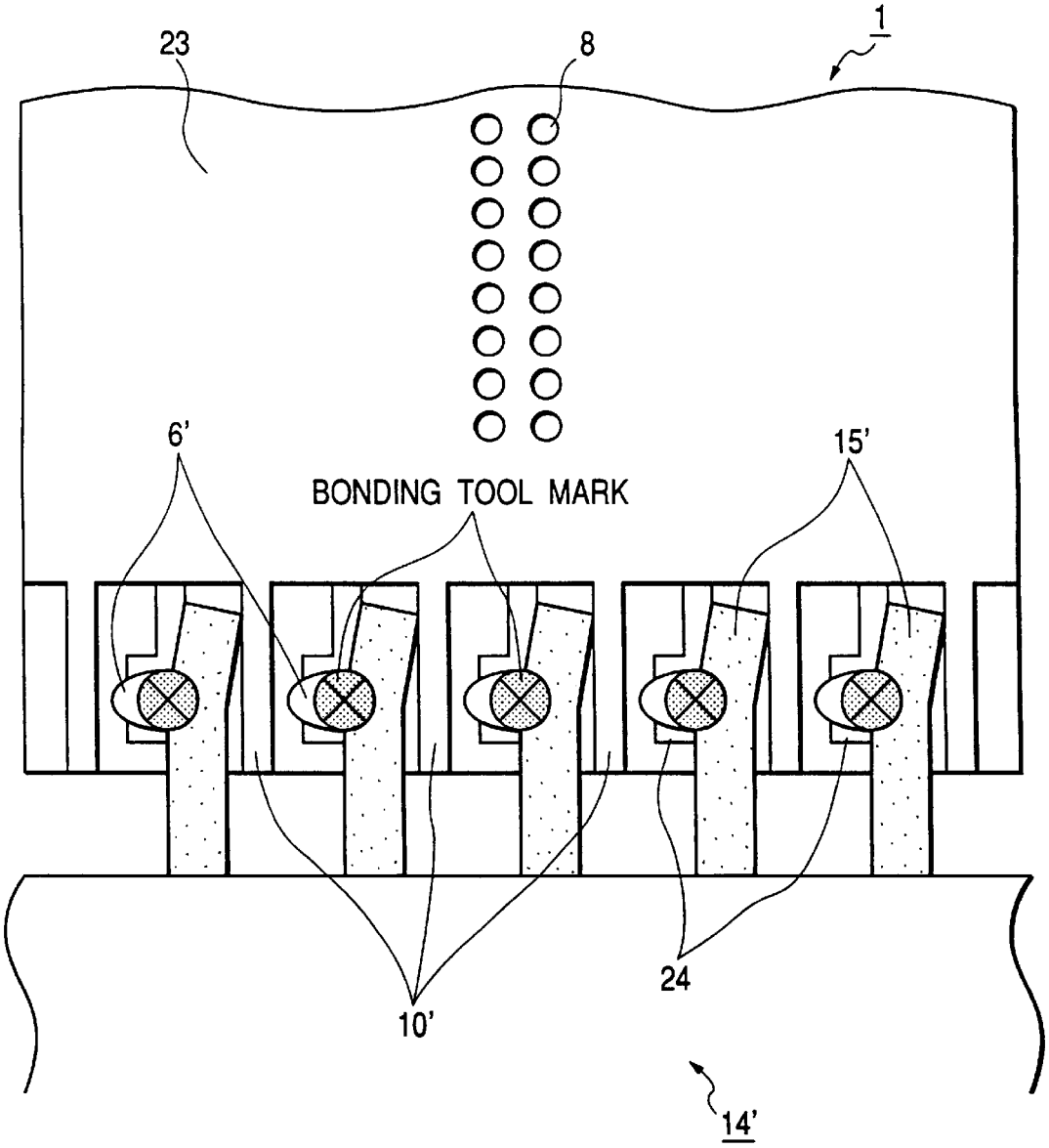
FIG. 9 is a top view for showing important parts of the recording element substrate and the electric wiring substrate after being connected to each other according to the first example of the second embodiment of the present invention.

FIG. 8A is a top view for showing important parts of the recording element substrate and the electric wiring substrate before being interconnected according to the first example of this embodiment and FIG. 8B is a cross-sectional view taken along line 8B—8B of FIG. 8A. Moreover, FIG. 9 is a schematic top view for showing the important parts of the recording element substrate and the electric wiring substrate after being interconnected according to the first example. In the configuration of this example, even if a shift in positioning occurred between each stud bump 6' and each connecting terminal 15' and, therefore, the load and supersonic wave vibration from the bonding tool caused the connecting terminal 15' to be bent as sliding over the stud bump 6' in a direction of the shift, or caused the stud bump 6' to be crushed as widened in a direction opposite to that in which the connecting terminal 15' was bent, the deformation of the connecting terminal 15' and the stud bump 6' can be suppressed by the insulating film 10' provided between the bump 6', thus effectively preventing electrical short-circuiting.

Figure 15:
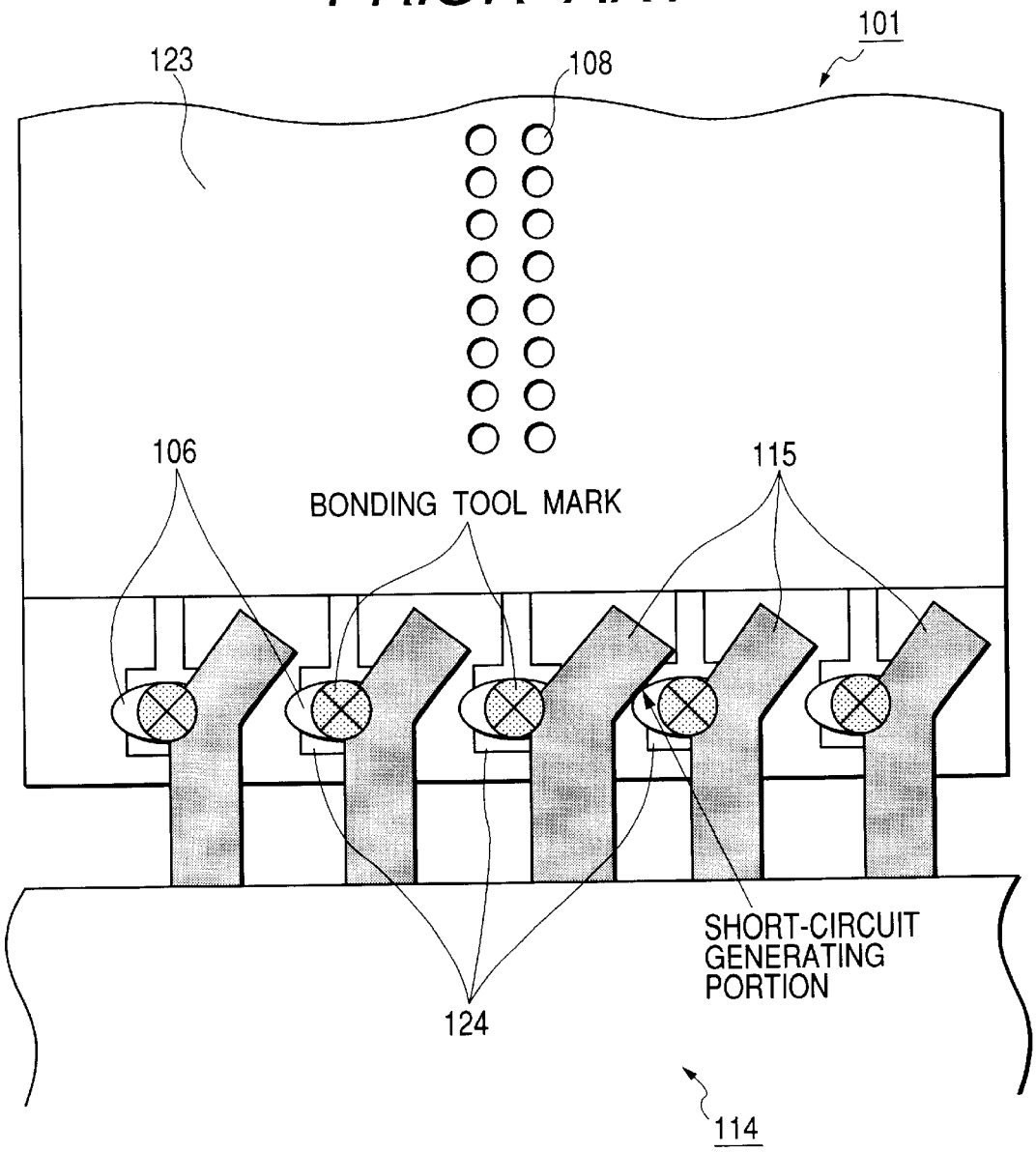
FIG. 15 PRIOR ART
FIG. 15 is a top view for showing important parts of the conventional recording element substrate and electric wiring substrate after being connected with each other.

FIG. 15 show a conventional arrangement comprising a plurality of connecting terminals 115 provided on an electric wiring substrate 114, a plurality of electrode pads 124 provided in parallel with each other on a recording element substrate 101, and a plurality of stud bumps 106 provided on the electrode pads. As shown in FIG. 15, in such a conventional arrangement, the connecting terminals 115 are bonded as shifted in a direction in which said electrode pads are arrayed. If the connection terminals 115 shift in positioning with respect to the stud bumps 6, the load and supersonic wave vibration given from the bonding tool causes the connecting terminals 115 to be connected in such a manner as to slide over the stud bumps 106, greatly shifted in the direction of the shift of the connecting terminals 115 with respect to the stud bumps 6, so that the connecting terminals 115 may in some cases come in electric contact with adjacent connecting terminals 115 or adjacent stud bumps 106, resulting in short-circuiting, thus breaking the recording head.

FIG. 10A is a top view for showing important parts of the recording element substrate and the electric wiring substrate before being interconnected according to a second example of this embodiment and FIG. 10B is a cross-sectional view taken along line 10B—10B of FIG. 10A. Moreover, FIG. 11 is a schematic top view for showing important parts of the recording element substrate and the electric wiring substrate after being interconnected. In this example, a plated bump 6" made of electroless nickel and electroless gold was connected with the connecting terminal 15' of the electric wiring substrate 14'. This example features that the electrode pad 24 provided on the recording element substrate 1 and the connecting terminal 15' provided on the electric wiring substrate 14' are electrically interconnected via the plated bump 6". The plated bump 6" is better than the stud bump 6' of the first example in height and flatness, thus giving such a configuration that a shift in positioning of the connecting terminal 15' may not be liable to give rise to sliding or extreme bump crushing.

Other Embodiments

The following will describe one example of a recording apparatus that can be mounted with the ink jet recording head according to any of the above-mentioned embodiments.

Figure 13:
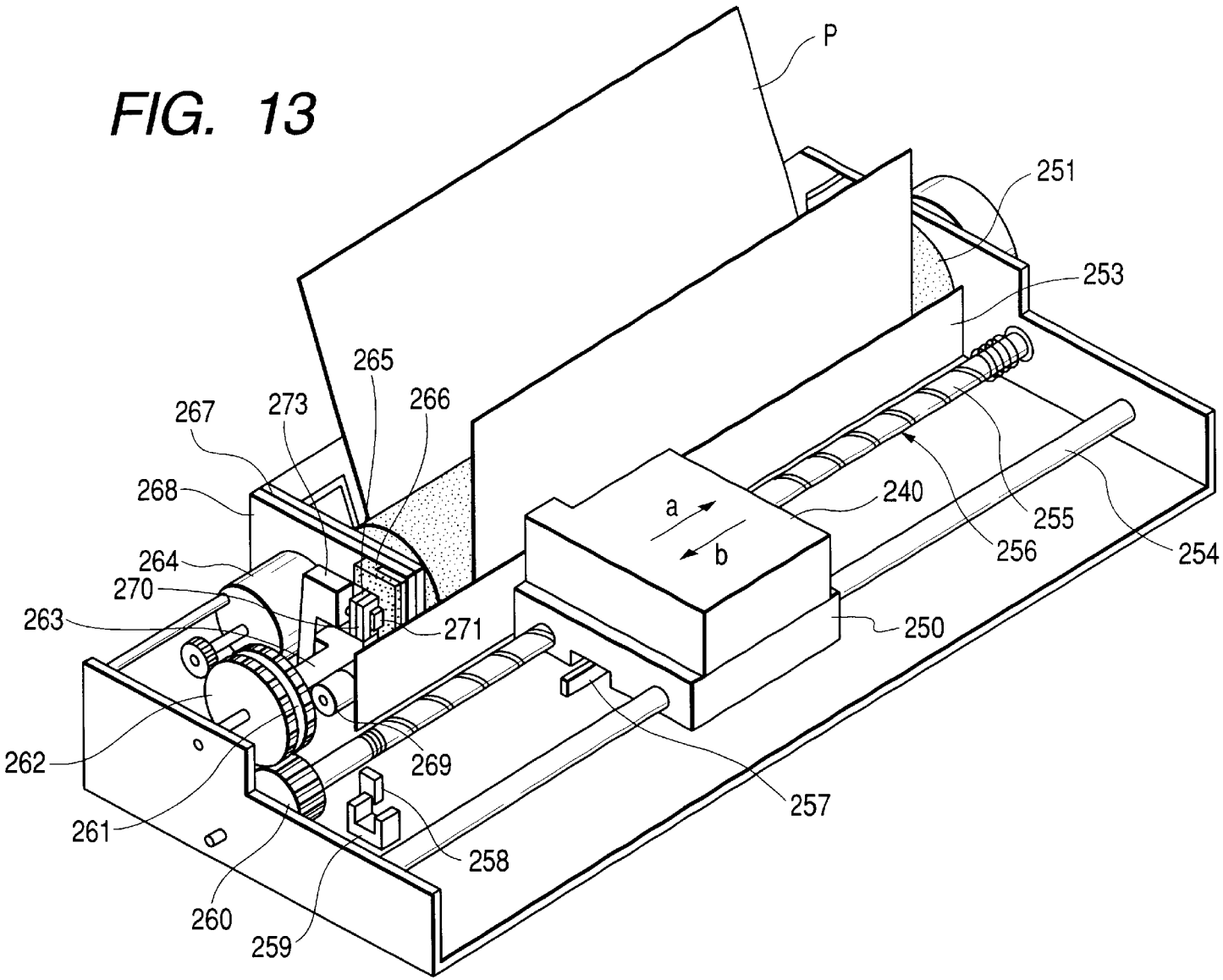
FIG. 13 is a perspective view for showing an ink jet recording apparatus according to the present invention.
Figure 14:
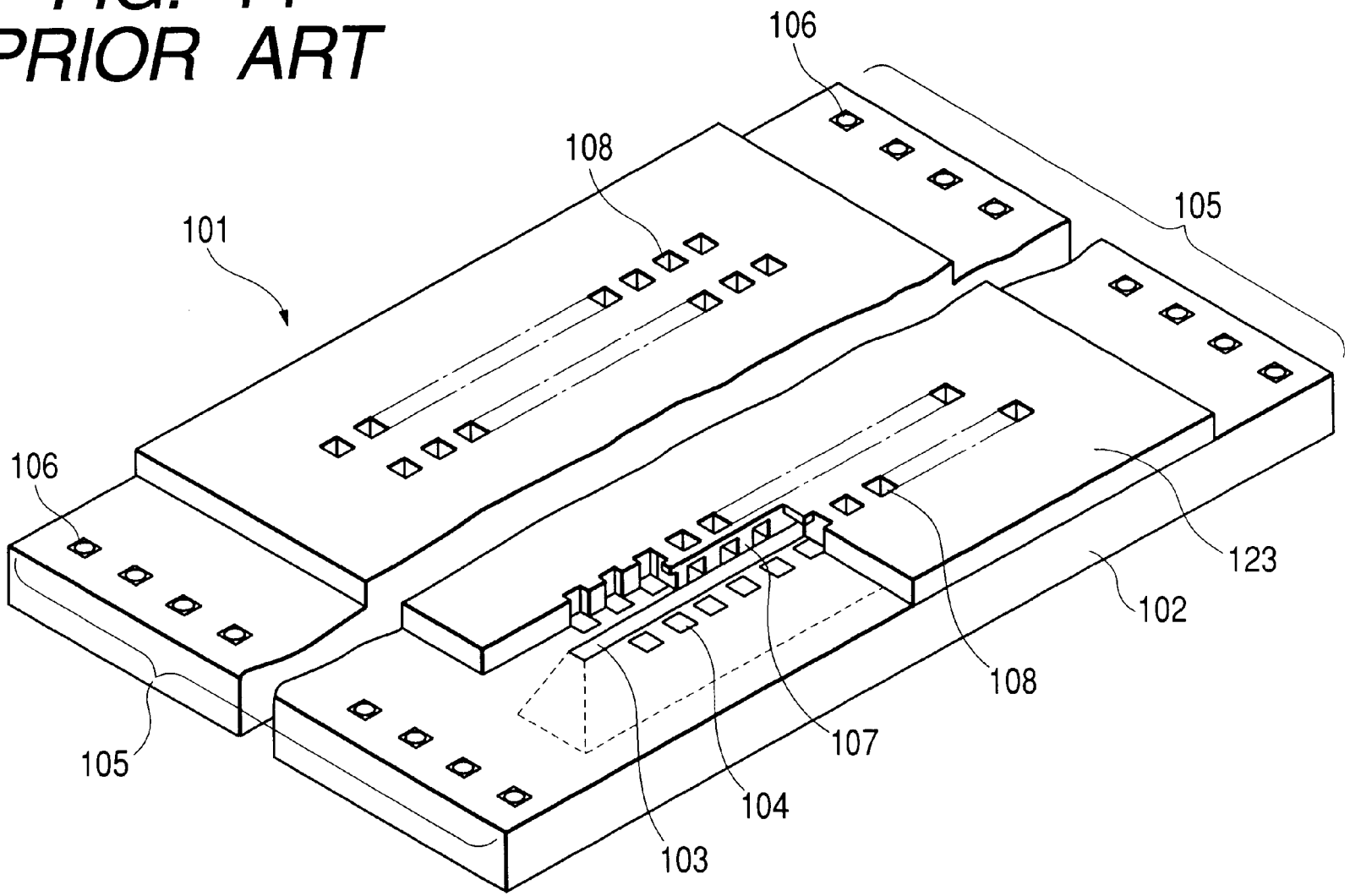
FIG. 14 PRIOR ART
FIG. 14 is a partially exploded perspective view for showing a conventional recording element substrate.

FIG. 13 is a perspective view for showing one configuration example of the recording apparatus of the present invention.

In FIG. 13, a lead screw 256 in which a spiral groove 255 is formed is interlocked with reverse/non-reverse rotation of a driving motor 264 to be driven in rotation via driving force transmitting gears 260 and 262.

A carriage 250 is engaged with the spiral groove 255 by a pin (not shown) and further guided along a guide rail 254 in a sliding manner, thus reciprocating in directions indicated by arrows a and b. The carriage 250 is mounted detachably with an ink jet cartridge 240 which is comprised integrally of an ink jet recording head having almost the same configuration as that indicated in the above-mentioned embodiments and a liquid reservoir for storing ink to be supplied to the ink jet recording head.

A paper pressure plate 253 presses a subject medium P against a platen roller 251 in a direction in which the carriage 250 moves.

Photo-couplers 258 and 259 constitute home-position detecting means for confirming the presence of a lever 257 of the carriage 250 in the region to reverse the rotation direction of the driving motor 264.

A cap member 270 for capping the front surface of the ink jet recording head is supported by a support member 265 and also provided with sucking means 273, to suck the ink jet recording head for recovery via an opening 271 formed in the cap.

A body support plate 267 has a support plate 268 attached thereto, so that a cleaning blade 266 supported by this support plate 268 in a sliding manner is moved back and forth by driving means not shown. The implementation of the cleaning blade 266 is not limited to that shown here but may take on any that is publicly known.

The lever 257 is used to start the operation of sucking for recovery, in such a manner that it starts moving when a cam 269 butting against the carriage 250 moves under the control of publicly known transmitting means such a gear 261 or a clutch 263 when it transmits the driving force from the driving motor 264.

Each of these operations of capping, cleaning, and sucking for recovery is performed at a corresponding position by the action of the lead screw 256 when the carriage 250 has come to a home-position side region. Any desired one of these operations needs only to be performed at a known timing so that this example can be applied thereto.

What is claimed is:

1. An ink jet recording head comprising:

a liquid discharging substrate provided with both (a) a plurality of energy generating elements for generating energy utilized to discharge liquid from a plurality of discharge ports, respectively, in response to an electric signal and (b) a plurality of connecting members electrically connected to said plurality of energy generating elements, respectively; and an electric wiring substrate having a plurality of connecting terminals connected to said plurality of connecting members, respectively, for transmitting an electric signal supplied from the outside to said plurality of energy generating elements, respectively, wherein each of said plurality of connecting members protrudes from said liquid discharging substrate by a predetermined first protrusion distance, said liquid discharging substrate has an insulating member comprised of at least one member disposed between two of said plurality of connecting members and protruding in the same direction as that in which said plurality of connecting members protrude, and a second protrusion distance of said insulating member is larger than the first protrusion distance of each of said plurality of connecting members.

2. The ink jet recording head according to claim 1, wherein each of said plurality of connecting terminals protrudes from said electric wiring substrate by a predetermined third protrusion distance in a direction opposite to the direction in which said connecting members and said insulating member protrude, in such a configuration that when said electric wiring substrate overlaps a portion of said liquid discharging substrate that has said plurality of connecting members formed thereon, said plurality of connecting terminals may be interconnected with said plurality of connecting members, respectively, and the second protrusion distance of said insulating member with respect to said liquid discharging substrate is smaller than a sum of the protrusion distance of each of said connecting members with respect to said liquid discharging substrate and the protrusion distance of each of said connecting terminals with respect to said electric wiring substrate.

3. The ink jet recording head according to claim 2, wherein a gap between said liquid discharging substrate and said electric wiring substrate is filled with a thermo-hardening adhesive agent at surroundings of connecting sections between said connecting members and said connecting terminals, respectively.

4. The ink jet recording head according to claim 3, wherein said thermo-hardening adhesive agent is an anisotropic conductive adhesive agent containing conductive particles.

5. The ink jet recording head according to claim 2, wherein said connecting members and said connecting terminals are electrically interconnected by gang bonding, whereby said connecting members and said connecting terminals are collectively heated under pressure to be interconnected.

6. The ink jet recording head according to claim 1, wherein on said liquid discharging substrate there is formed a member constituting a liquid chamber in which said plurality of discharge ports are formed and which is filled with the liquid, and said insulating member is made of the same material as the material of said member constituting said liquid chamber.

7. The ink jet recording head according to claim 1, wherein on said liquid discharging substrate there is formed a liquid chamber filled with liquid that is constituted by an orifice member having said plurality of discharge ports formed therein and a partition member comprised of at least one member separating some of said plurality of energy generating elements from others of said plurality of energy generating elements, and said insulating member is made of the same material as the material of said partition member.

8. The ink jet recording head according to claim 1, wherein said insulating member is formed integrally with a member for forming a liquid chamber.

9. The ink jet recording head according to claim 1, wherein said connecting members and said connecting terminals are electrically interconnected by single-point bonding, whereby said connecting members and said connecting terminals are interconnected by applying a supersonic load.

10. An ink jet recording apparatus comprising:

the ink jet recording head according to any one of claims 1 to 9; and a carriage for carrying said head.

* * * * *